US009959830B2

(12) United States Patent
Xiao et al.

(10) Patent No.: US 9,959,830 B2
(45) Date of Patent: May 1, 2018

(54) GOA CIRCUIT

(71) Applicant: Wuhan China Star Optoelectronics Technology Co., Ltd., Wuhan (CN)

(72) Inventors: Juncheng Xiao, Wuhan (CN); Yao Yan, Wuhan (CN); Ronglei Dai, Wuhan (CN); Shangcao Cao, Wuhan (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 252 days.

(21) Appl. No.: 15/026,256

(22) PCT Filed: Feb. 24, 2016

(86) PCT No.: PCT/CN2016/074465
§ 371 (c)(1),
(2) Date: Mar. 31, 2016

(87) PCT Pub. No.: WO2017/117846
PCT Pub. Date: Jul. 13, 2017

(65) Prior Publication Data

US 2018/0068628 A1 Mar. 8, 2018

(30) Foreign Application Priority Data

Jan. 4, 2016 (CN) ..... 2016 1 0003068

(51) Int. Cl.
*G09G 3/36* (2006.01)

(52) U.S. Cl.
CPC ..... *G09G 3/3677* (2013.01); *G09G 3/3648* (2013.01); *G09G 2300/0408* (2013.01);
(Continued)

(58) Field of Classification Search
CPC ..... G09G 3/3677; G09G 3/3648; G09G 2310/0289; G09G 2310/08;
(Continued)

(56) References Cited

U.S. PATENT DOCUMENTS

2010/0309191 A1* 12/2010 Hsu ..... G09G 3/3677 345/213
2013/0162508 A1* 6/2013 Li ..... G09G 3/3677 345/92
2016/0086562 A1* 3/2016 Tan ..... G09G 3/3677 345/215

FOREIGN PATENT DOCUMENTS

WO WO 2017031774 A1 * 3/2017 ..... G09G 3/36

* cited by examiner

*Primary Examiner* — Abhishek Sarma
(74) *Attorney, Agent, or Firm* — Leong C. Lei

(57) ABSTRACT

The present invention provides a GOA circuit, comprising a forward-backward scan control module, an output module, an output pull-down module, a node control module, a second node signal input module, a second node signal control module, a voltage stabilizing module and a second capacitor; the forward scan of the circuit is controlled with the ninth and the tenth thin film transistors, and the signal input of the second node is controlled with the first and the eleventh thin film transistors, and the mutual control of the first node and the second node are achieved with the second, the fourth and the fifth thin film transistors, and meanwhile, as the GOA circuit applies to a display of dual side drive interlaced scan structure, the GOA circuits of the two sides can respectively receive four different clock signals to reduce the loading of the signal line of the GOA circuit.

17 Claims, 7 Drawing Sheets

(52) U.S. Cl.
CPC . *G09G 2310/0289* (2013.01); *G09G 2310/08* (2013.01); *G09G 2330/023* (2013.01); *G09G 2340/145* (2013.01)

(58) Field of Classification Search
CPC ..... G09G 2300/0408; G09G 2330/023; G09G 2340/145
See application file for complete search history.

GOA CIRCUIT

FIELD OF THE INVENTION

The present invention relates to a display technology field, and more particularly to a GOA circuit.

BACKGROUND OF THE INVENTION

The Liquid Crystal Display (LCD) possesses advantages of thin body, power saving and no radiation to be widely used in many application scope, such as LCD TV, mobile phone, personal digital assistant (PDA), digital camera, notebook, laptop, and dominates the flat panel display field.

Most of the liquid crystal displays on the present market are backlight type liquid crystal displays, which comprise a liquid crystal display panel and a backlight module. The working principle of the liquid crystal display panel is that the Liquid Crystal is injected between the Thin Film Transistor Array Substrate (TFT array substrate) and the Color Filter (CF). The light of backlight module is refracted to generate images by applying driving voltages to the two substrates for controlling the rotations of the liquid crystal molecules.

The Active Matrix Liquid Crystal Display (AMLCD) is the most common liquid crystal display at present. The Active Matrix Liquid Crystal Display comprises a plurality of pixels, and each pixel is controlled by one Thin Film Transistor (TFT). The gate of the TFT is coupled to the scan line extending along the horizontal direction. The drain of the TFT is coupled to the data line extending along the vertical direction. The source is coupled to the corresponding pixel electrode. When a sufficient positive voltage is applied to some scan line in the horizontal direction, all the TFT coupled to the scan line will be activated to write the data signal loaded in the data line into the pixel electrodes and thus to show images to control the transmittances of different liquid crystals to achieve the effect of controlling colors.

The driving of the level scan line (i.e. the gate driving) in the present active matrix liquid crystal display is initially accomplished by the external Integrated Circuit (IC). The external IC can control the charge and discharge stage by stage of the level scan lines of respective stages. The GOA technology, i.e. the Gate Driver on Array technology can utilize the array manufacture processes of the liquid crystal display panel to manufacture the driving circuit of the level scan lines on the substrate around the active area, to replace the external IC for accomplishing the driving of the level scan lines. The GOA technology can reduce the bonding procedure of the external IC and has potential to raise the productivity and lower the production cost. Meanwhile, it can make the liquid crystal display panel more suitable to the narrow frame design of display products.

With the population of the smart phones, the consumers have higher and higher requirements for the resolution of the small size display of the phone screen. For the display of the same size, the higher resolution means the higher Pixels Per Inch (PPI). The higher the PPI is, the requirement of the display for the driving circuit signal delay also becomes higher, and more particularly for the small size displays. However, in the GOA circuit according to prior art, the issue of signal line over loading exists and is not suitable for the display of small size, high resolution. Furthermore, the power consumption of the GOA circuit according to prior art is larger. How to reduce the power consumption is the research topic of the display.

SUMMARY OF THE INVENTION

An objective of the present invention is to provide a GOA circuit, which can be adaptable to the working requirements of the display with small size, high resolution, and can reduce the loading of the signal line of the GOA circuit for weakening the delay level of the signal and reducing the power consumption of the GOA circuit.

For realizing the aforesaid objective, the present invention provides a GOA circuit, comprising: GOA units of a plurality of stages which are cascade coupled, and the GOA unit of each stage comprises: a forward-backward scan control module, an output module, an output pull-down module, a node control module, a second node signal input module, a second node signal control module, a voltage stabilizing module and a second capacitor;

n is set to be a positive integer, and except the GOA unit of the first stage, the GOA unit of the second stage, the GOA unit of the next to last stage and the GOA unit of the last stage, in the GOA unit of the nth stage:

the forward-backward scan control module comprises: a ninth thin film transistor, and a gate of the ninth thin film transistor is electrically coupled to an output end of the two former stage n−2th GOA unit, and a source receives a forward scan direct current control signal, and a drain is electrically coupled to a third node; and a tenth thin film transistor, and a gate of the tenth thin film transistor is electrically coupled to an output end of the two latter stage n+2th GOA unit, and a source receives a backward scan direct current control signal, and a drain is electrically coupled to a third node;

the output module comprises: a seventh thin film transistor, and a gate of the seventh thin film transistor is electrically coupled to the first node, and a source receives a Mth clock signal, and a drain is electrically coupled to an output end; and a first capacitor, and one end of the first capacitor is electrically coupled to the first node, and the other end is electrically coupled to the output end;

the output pull-down module comprises: an eighth thin film transistor, and a gate of the eighth thin film transistor is electrically coupled to a second node, and a source receive a second constant voltage level, and a drain is electrically coupled to an output end;

the node control module comprises: a fourth thin film transistor, and a gate of the fourth thin film transistor receives the Mth clock signal, and a source is electrically coupled to the third node, and a drain is electrically coupled to a drain of a fifth thin film transistor; the fifth thin film transistor, and a gate of the fifth thin film transistor is electrically coupled to the second node, and a source receives the second constant voltage level; and a second thin film transistor, and a gate of the second thin film transistor is electrically coupled to the third node, and a source is electrically coupled to the second node, and a drain is electrically coupled to a fourth node;

the second node signal input module comprises: a third thin film transistor, and a gate of the third thin film transistor is electrically coupled to the fourth node, and a source is electrically coupled to a first constant voltage level, and a drain is electrically coupled to the second node;

the second node signal control module comprises: a first thin film transistor, and a gate of the first thin film transistor receives the forward scan direct current control signal, and a source receives a M−2th clock signal, and a drain is electrically coupled to the fourth node; and an eleventh thin film transistor, and a gate of the eleventh thin film transistor receives the backward scan direct current control signal, and a source receives a M+2th clock signal, and a drain is electrically coupled to the fourth node;

the voltage stabilizing module comprises: a sixth thin film transistor, and a gate of the sixth thin film transistor receives the first constant voltage level, and a source is electrically coupled to the third node, and a drain is electrically coupled to the first node;

one end of the second capacitor is electrically coupled to the second node, and the other end is electrically coupled to the second constant voltage level;

the voltages of the forward scan direct current control signal and the backward scan direct current control signal are one high and one low, and the voltages of the first constant voltage level and the second constant voltage level are one high and one low.

In the first stage GOA unit and the second stage GOA unit, the gate of the ninth thin film transistor receives a start signal of the circuit.

In the next to last stage GOA unit and the last stage GOA unit, the gate of the tenth thin film transistor receives a start signal of the circuit.

The respective thin film transistors are all N-type thin film transistors, and the first constant voltage level is a constant high voltage level, and the second constant voltage level is a constant low voltage level.

As performing forward scan, the forward scan direct current control signal is high voltage level and the backward scan direct current control signal is low voltage level; and as performing backward scan, the forward scan direct current control signal is low voltage level and the backward scan direct current control signal is high voltage level.

Selectably, the respective thin film transistors are all P-type thin film transistors, and the first constant voltage level is a constant low voltage level, and the second constant voltage level is a constant high voltage level.

As performing forward scan, the forward scan direct current control signal is low voltage level and the backward scan direct current control signal is high voltage level; and as performing backward scan, the forward scan direct current control signal is high voltage level and the backward scan direct current control signal is low voltage level.

As the GOA circuit of the present invention applies to a display of dual side drive interlaced scan structure, two GOA circuit are respectively at left, right two sides of display active display area, the GOA circuit of one side only comprises the odd stage GOA units, and the GOA circuit of the other side only comprises even stage GOA units;

wherein the respective GOA units in the GOA circuit at the one side receive four clock signals: a first clock signal, a third clock signal, a fifth clock signal and a seventh clock signal; the respective GOA units in the GOA circuit at the other side receive four clock signals: a second clock signal, a fourth clock signal, a sixth clock signal and an eighth clock signal.

The pulse periods of the first, second, third, fourth, fifth, sixth, seventh and eighth clock signals are the same, and while a pulse signal of the former clock signal is finished, a pulse signal of the latter clock signal is generated.

As the Mth clock signal is the first clock signal, the M−2th clock signal is the seventh clock signal; as the Mth clock signal is the second clock signal, the M−2th clock signal is the eighth clock signal; as the Mth clock signal is the seventh clock signal, the M+2th clock signal is the first clock signal; as the Mth clock signal is the eighth clock signal, the M+2th clock signal is the second clock signal.

The present invention further provides a GOA circuit, comprising: GOA units of a plurality of stages which are cascade coupled, and the GOA unit of each stage comprises: a forward-backward scan control module, an output module, an output pull-down module, a node control module, a second node signal input module, a second node signal control module, a voltage stabilizing module and a second capacitor;

n is set to be a positive integer, and except the GOA unit of the first stage, the GOA unit of the second stage, the GOA unit of the next to last stage and the GOA unit of the last stage, in the GOA unit of the nth stage:

the forward-backward scan control module comprises: a ninth thin film transistor, and a gate of the ninth thin film transistor is electrically coupled to an output end of the two former stage n−2th GOA unit, and a source receives a forward scan direct current control signal, and a drain is electrically coupled to a third node; and a tenth thin film transistor, and a gate of the tenth thin film transistor is electrically coupled to an output end of the two latter stage n+2th GOA unit, and a source receives a backward scan direct current control signal, and a drain is electrically coupled to a third node;

the output module comprises: a seventh thin film transistor, and a gate of the seventh thin film transistor is electrically coupled to the first node, and a source receives a Mth clock signal, and a drain is electrically coupled to an output end; and a first capacitor, and one end of the first capacitor is electrically coupled to the first node, and the other end is electrically coupled to the output end;

the output pull-down module comprises: an eighth thin film transistor, and a gate of the eighth thin film transistor is electrically coupled to a second node, and a source receive a second constant voltage level, and a drain is electrically coupled to an output end;

the node control module comprises: a fourth thin film transistor, and a gate of the fourth thin film transistor receives the Mth clock signal, and a source is electrically coupled to the third node, and a drain is electrically coupled to a drain of a fifth thin film transistor; the fifth thin film transistor, and a gate of the fifth thin film transistor is electrically coupled to the second node, and a source receives the second constant voltage level; and a second thin film transistor, and a gate of the second thin film transistor is electrically coupled to the third node, and a source is electrically coupled to the second node, and a drain is electrically coupled to a fourth node;

the second node signal input module comprises: a third thin film transistor, and a gate of the third thin film transistor is electrically coupled to the fourth node, and a source is electrically coupled to a first constant voltage level, and a drain is electrically coupled to the second node;

the second node signal control module comprises: a first thin film transistor, and a gate of the first thin film transistor receives the forward scan direct current control signal, and a source receives a M−2th clock signal, and a drain is electrically coupled to the fourth node; and an eleventh thin film transistor, and a gate of the eleventh thin film transistor receives the backward scan direct current control signal, and a source receives a M+2th clock signal, and a drain is electrically coupled to the fourth node;

the voltage stabilizing module comprises: a sixth thin film transistor, and a gate of the sixth thin film transistor receives the first constant voltage level, and a source is electrically coupled to the third node, and a drain is electrically coupled to the first node;

one end of the second capacitor is electrically coupled to the second node, and the other end is electrically coupled to the second constant voltage level;

the voltages of the forward scan direct current control signal and the backward scan direct current control signal are one high and one low, and the voltages of the first constant voltage level and the second constant voltage level are one high and one low;

wherein in the first stage GOA unit and the second stage GOA unit, the gate of the ninth thin film transistor receives a start signal of the circuit;

wherein in the next to last stage GOA unit and the last stage GOA unit, the gate of the tenth thin film transistor receives a start signal of the circuit;

wherein as applying to a display of dual side drive interlaced scan structure, two GOA circuit are respectively at left, right two sides of display active display area, the GOA circuit of one side only comprises the odd stage GOA units, and the GOA circuit of the other side only comprises even stage GOA units;

wherein the respective GOA units in the GOA circuit at the one side receive four clock signals: a first clock signal, a third clock signal, a fifth clock signal and a seventh clock signal; the respective GOA units in the GOA circuit at the other side receive four clock signals: a second clock signal, a fourth clock signal, a sixth clock signal and an eighth clock signal.

The benefits of the present invention are: the present invention provides a GOA circuit comprising a forward-backward scan control module, an output module, an output pull-down module, a node control module, a second node signal input module, a second node signal control module, a voltage stabilizing module and a second capacitor; the forward scan of the circuit is controlled with the ninth and the tenth thin film transistors, and the signal input of the second node is controlled with the first and the eleventh thin film transistors to achieve the low voltage level output of the GOA circuit in the non-working stage, and the mutual control of the first node and the second node are achieved with the second, the fourth and the fifth thin film transistors, and meanwhile, as the GOA circuit applies to a display of dual side drive interlaced scan structure, the GOA circuits of the two sides can respectively receive four different clock signals to reduce the loading of the signal line of the GOA circuit for weakening the delay level of the signal and reducing the power consumption of the GOA circuit, and thus to be adaptable to the working requirements of the display with small size, high resolution.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
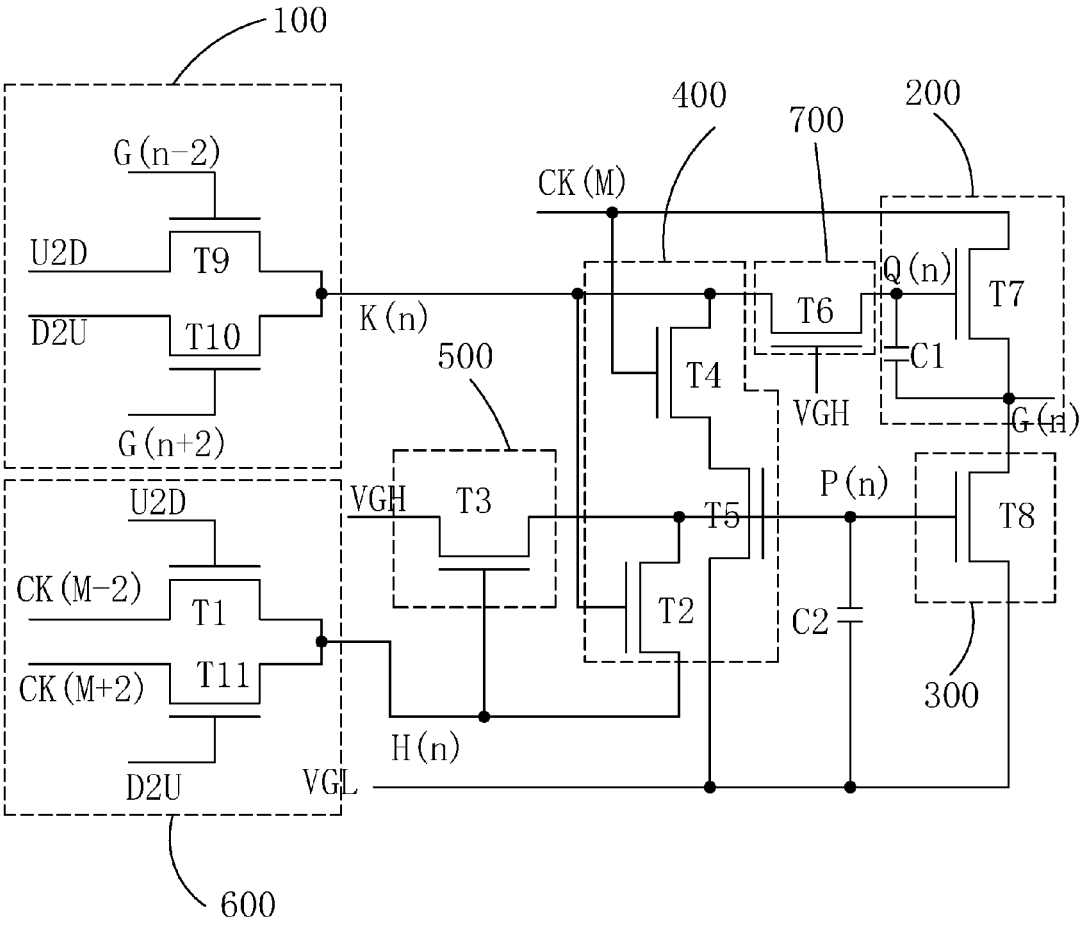
FIG. 1 is a circuit diagram of the first embodiment according to the GOA circuit of the present invention.
Figure 7:
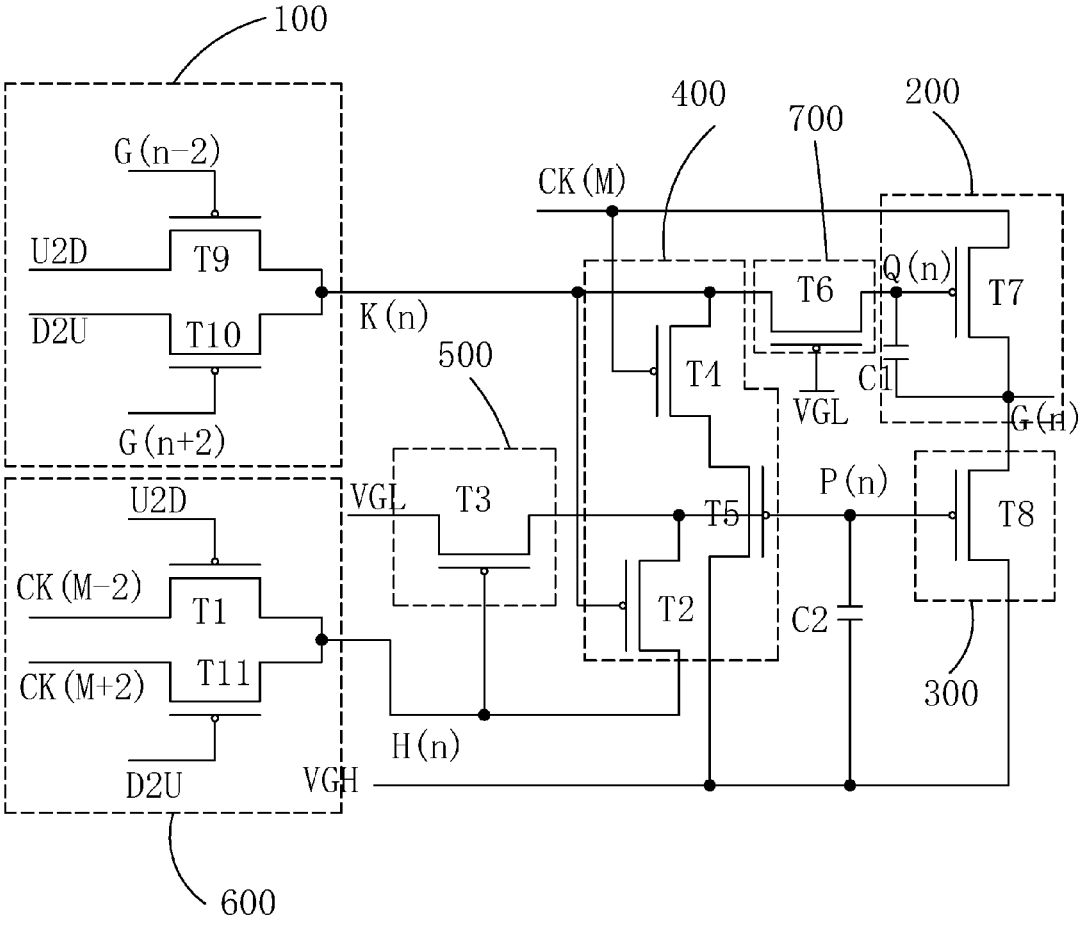
FIG. 7 is a circuit diagram of the second embodiment according to the GOA circuit of the present invention.

Please refer to FIG. 1 or FIG. 7. The present invention provides a GOA circuit, comprising: GOA units of a plurality of stages which are cascade coupled, and the GOA unit of each stage comprises: a forward-backward scan control module 100, an output module 200, an output pull-down module 300, a node control module 400, a second node signal input module 500, a second node signal control module 600, a voltage stabilizing module 700 and a second capacitor C2.

n is set to be a positive integer, and except the GOA unit of the first stage, the GOA unit of the second stage, the GOA unit of the next to last stage and the GOA unit of the last stage, in the GOA unit of the nth stage:

the forward-backward scan control module 100 comprises: a ninth thin film transistor T9, and a gate of the ninth thin film transistor T9 is electrically coupled to an output end G(n−2) of the two former stage n−2th GOA unit, and a source receives a forward scan direct current control signal U2D, and a drain is electrically coupled to a third node K(n); and a tenth thin film transistor T10, and a gate of the tenth thin film transistor T10 is electrically coupled to an output end G(n+2) of the of the two latter stage n+2th GOA unit, and a source receives a backward scan direct current control signal D2U, and a drain is electrically coupled to a third node K(n);

the output module 200 comprises: a seventh thin film transistor T7, and a gate of the seventh thin film transistor T7 is electrically coupled to the first node Q(n), and a source is electrically coupled to a Mth clock signal CK(M), and a drain is electrically coupled to an output end G(n); and a first capacitor C1, and one end of the first capacitor C1 is electrically coupled to the first node Q(n), and the other end is electrically coupled to the output end G(n);

the output pull-down module 300 comprises: an eighth thin film transistor T8, and a gate of the eighth thin film transistor T8 is electrically coupled to a second node P(n), and a source receive a second constant voltage level, and a drain is electrically coupled to an output end G(n);

the node control module 400 comprises: a fourth thin film transistor T4, and a gate of the fourth thin film transistor T4 receives the Mth clock signal CK(M), and a source is electrically coupled to the third node K(n), and a drain is electrically coupled to a drain of a fifth thin film transistor T5; the fifth thin film transistor T5, and a gate of the fifth thin film transistor T5 is electrically coupled to the second node P(n), and a source receives the second constant voltage level; and a second thin film transistor T2, and a gate of the second thin film transistor T2 is electrically coupled to the third node K(n), and a source is electrically coupled to the second node P(n), and a drain is electrically coupled to a fourth node H(n);

the second node signal input module 500 comprises: a third thin film transistor T3, and a gate of the third thin film transistor T3 is electrically coupled to the fourth node H(n), and a source is electrically coupled to a first constant voltage level, and a drain is electrically coupled to the second node P(n);

the second node signal control module 600 comprises: a first thin film transistor T1, and a gate of the first thin film transistor T1 receives the forward scan direct current control signal U2D, and a source receives a M−2th clock signal CK(M−2), and a drain is electrically coupled to the fourth node H(n); and an eleventh thin film transistor T11, and a gate of the eleventh thin film transistor T11 receives the backward scan direct current control signal D2U, and a source receives a M+2th clock signal CK(M+2), and a drain is electrically coupled to the fourth node H(n);

the voltage stabilizing module 700 comprises: a sixth thin film transistor T6, and a gate of the sixth thin film transistor T6 receives the first constant voltage level, and a source is electrically coupled to the third node K(n), and a drain is electrically coupled to the first node Q(n);

one end of the second capacitor C2 is electrically coupled to the second node P(n), and the other end is electrically coupled to the second constant voltage level;

the voltages of the forward scan direct current control signal U2D and the backward scan direct current control signal D2U are one high and one low, and the voltages of the first constant voltage level and the second constant voltage level are one high and one low.

Figure 3:
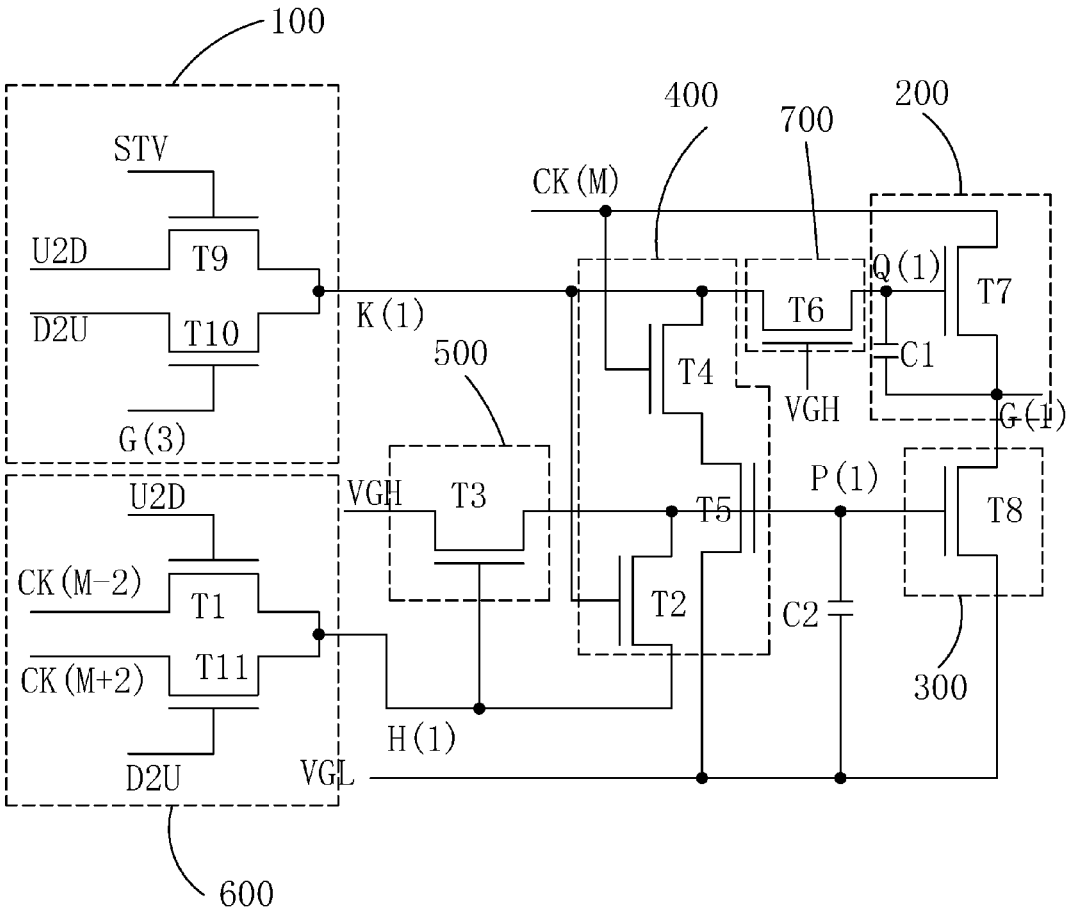
FIG. 3 is a circuit diagram of the first stage GOA unit of the first embodiment according to the GOA circuit of the present invention.
Figure 4:
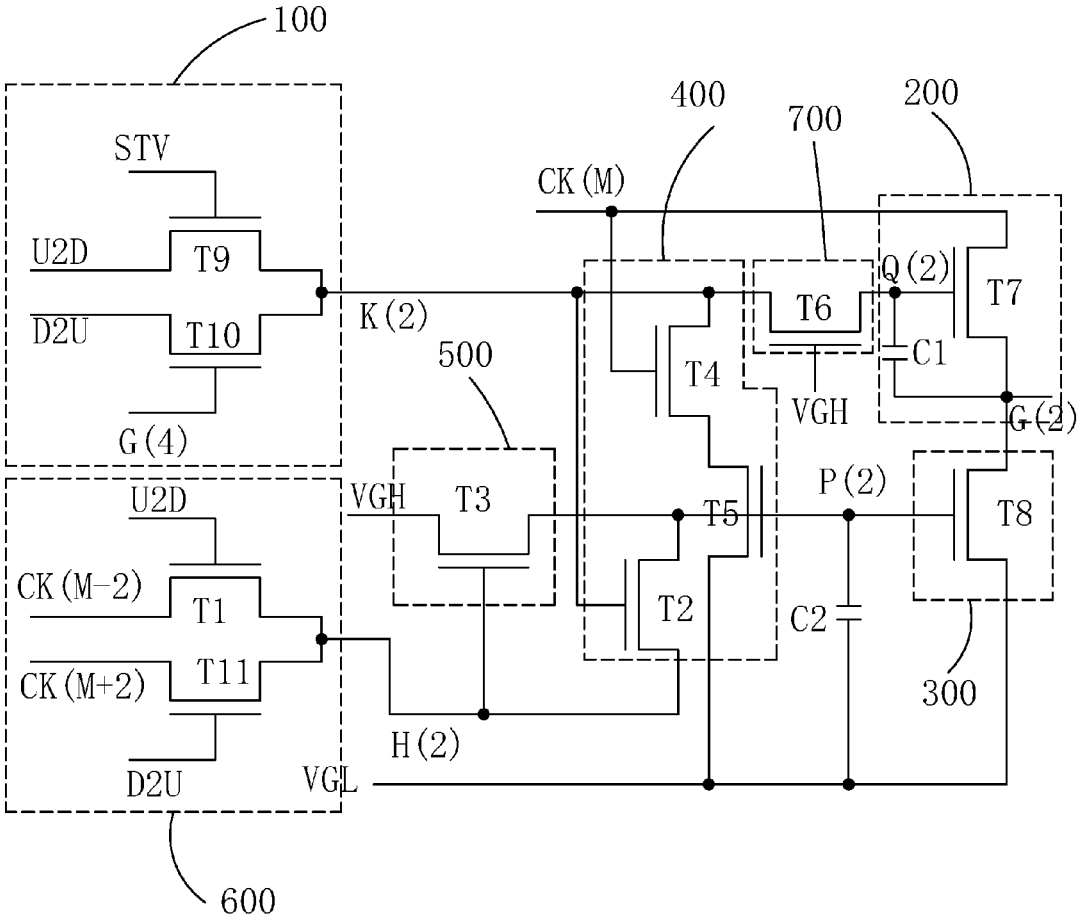
FIG. 4 is a circuit diagram of the second stage GOA unit of the first embodiment according to the GOA circuit of the present invention.
Figure 5:
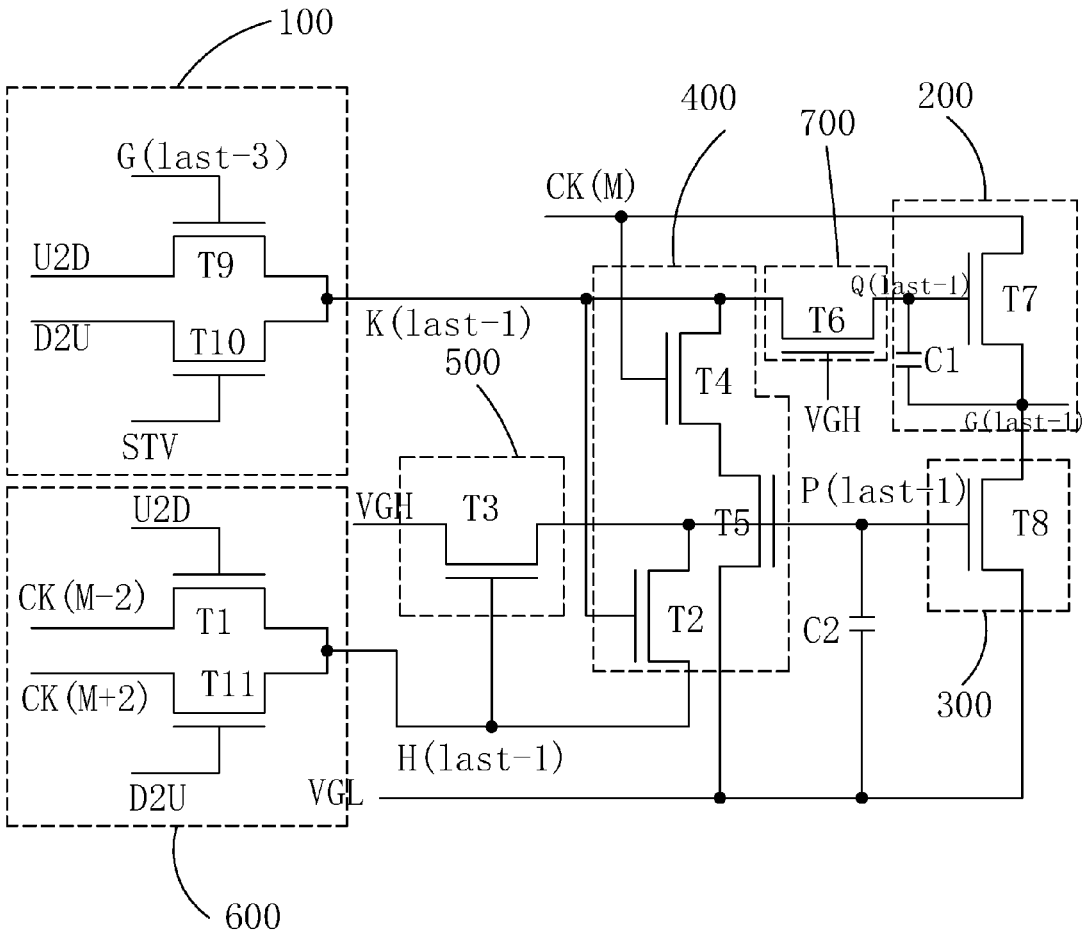
FIG. 5 is a circuit diagram of the next to last stage GOA unit of the first embodiment according to the GOA circuit of the present invention.
Figure 6:
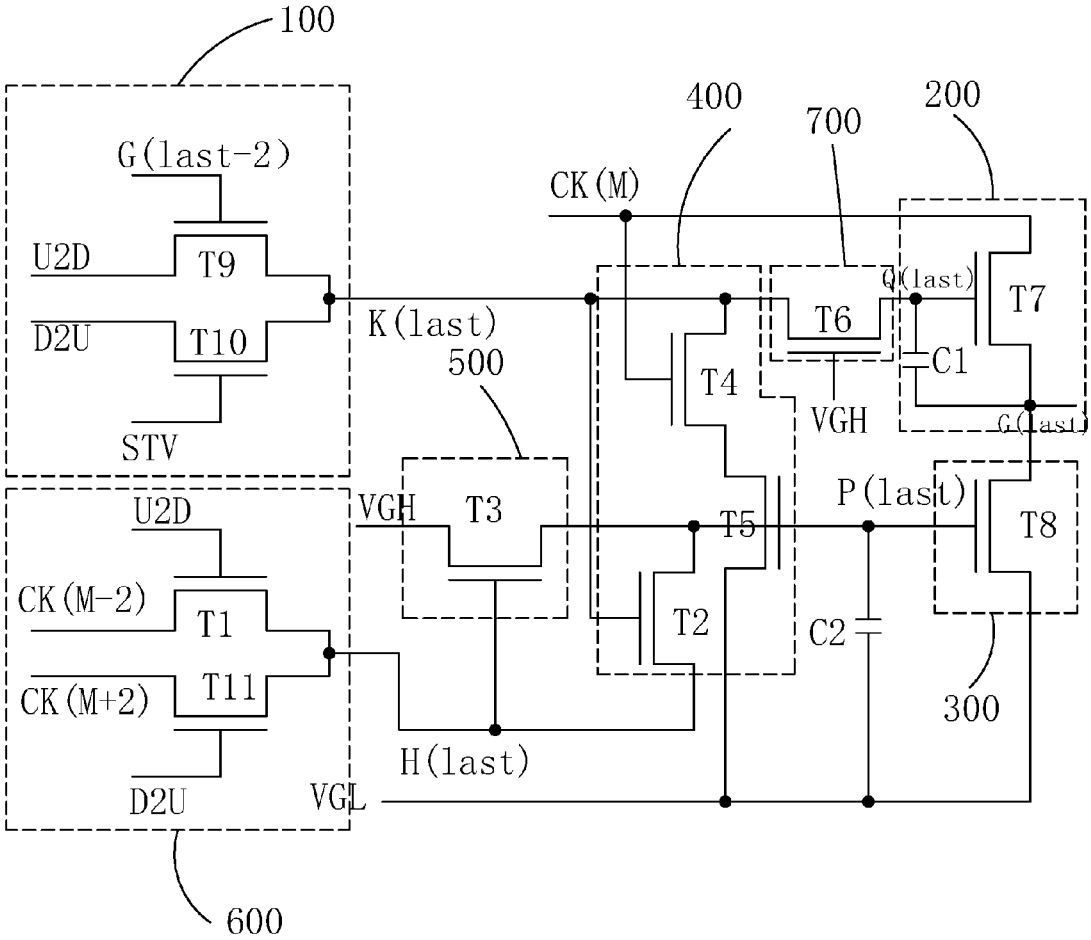
FIG. 6 is a circuit diagram of the last stage GOA unit of the first embodiment according to the GOA circuit of the present invention.

Particularly, as shown in FIG. 3, FIG. 4, in the first stage GOA unit and the second stage GOA unit, the gate of the ninth thin film transistor T9 receives a start signal STV of the circuit; as shown in FIG. 5, FIG. 6, in the next to last stage GOA unit and the last stage GOA unit, the gate of the tenth thin film transistor T10 receives a start signal SW of the circuit.

Selectably, referring to FIG. 1, in the first embodiment of the present invention, the respective thin film transistors are all N-type thin film transistors, and then, the first constant voltage level is a constant high voltage level VGH, and the second constant voltage level is a constant low voltage level VGL. As performing forward scan, the forward scan direct current control signal U2D is high voltage level and the backward scan direct current control signal D2U is low voltage level; and as performing backward scan, the forward scan direct current control signal U2D is low voltage level and the backward scan direct current control signal D2U is high voltage level.

Selectably, referring to FIG. 7, in the second embodiment of the present invention, the respective thin film transistors are all P-type thin film transistors, and the first constant voltage level is a constant low voltage level VGL, and the second constant voltage level is a constant high voltage level VGH; as performing forward scan, the forward scan direct current control signal U2D is low voltage level and the backward scan direct current control signal D2U is high voltage level; and as performing backward scan, the forward scan direct current control signal U2D is high voltage level and the backward scan direct current control signal D2U is low voltage level.

Preferably, the constant high voltage level VGH is 10V, and the constant low voltage level VGL is −7V; the pulse high voltage levels of the respective clock signals are 10V, and the pulse low voltage levels are −7V; the forward scan direct current control signal U2D is 10V at high voltage level, and −7V at low voltage level; the backward scan direct current control signal D2U is −7V at low voltage level, and 10V at high voltage level.

Furthermore, as the GOA circuit of the present invention applies to a display of dual side drive interlaced scan structure, two GOA circuit are respectively at left, right two sides of display active display area, the GOA circuit of one side only comprises the odd stage GOA units, and the GOA circuit of the other side only comprises even stage GOA units;

wherein the respective GOA units in the GOA circuit at the one side receive four clock signals: a first clock signal CK(1), a third clock signal CK(3), a fifth clock signal CK(5) and a seventh clock signal CK(7); the respective GOA units in the GOA circuit at the other side receive four clock signals: a second clock signal CK(2), a fourth clock signal CK(4), a sixth clock signal CK(6) and an eighth clock signal CK(8).

Specifically, as the Mth clock signal CK(M) is the first clock signal CK(1), the M−2th clock signal CK(M−2) is the seventh clock signal CK(7); as the Mth clock signal CK(M) is the second clock signal CK(2), the M−2th clock signal CK(M−2) is the eighth clock signal CK(8); as the Mth clock signal CK(M) is the seventh clock signal CK(7), the M+2th clock signal CK(M+2) is the first clock signal CK(1); as the Mth clock signal CK(M) is the eighth clock signal CK(8), the M+2th clock signal CK(M+2) is the second clock signal CK(2). Preferably, in the first stage GOA unit, the Mth clock signal is the third clock signal CK(3), and in the second stage GOA unit, the Mth clock signal is the fourth clock signal CK(4), and in the third stage GOA unit, the Mth clock signal is the fifth clock signal CK(5), and in the fourth stage GOA unit, the Mth clock signal is the sixth clock signal CK(6), and in the fifth stage GOA unit, the Mth clock signal is the seventh clock signal CK(7), and in the sixth stage GOA unit, the Mth clock signal is the eighth clock signal CK(8), and in the seventh stage GOA unit, the Mth clock signal is the first clock signal CK(1), and in the eighth stage GOA unit, the Mth clock signal is the second clock signal CK(2), and so on to the last stage GOA unit.

Figure 2:
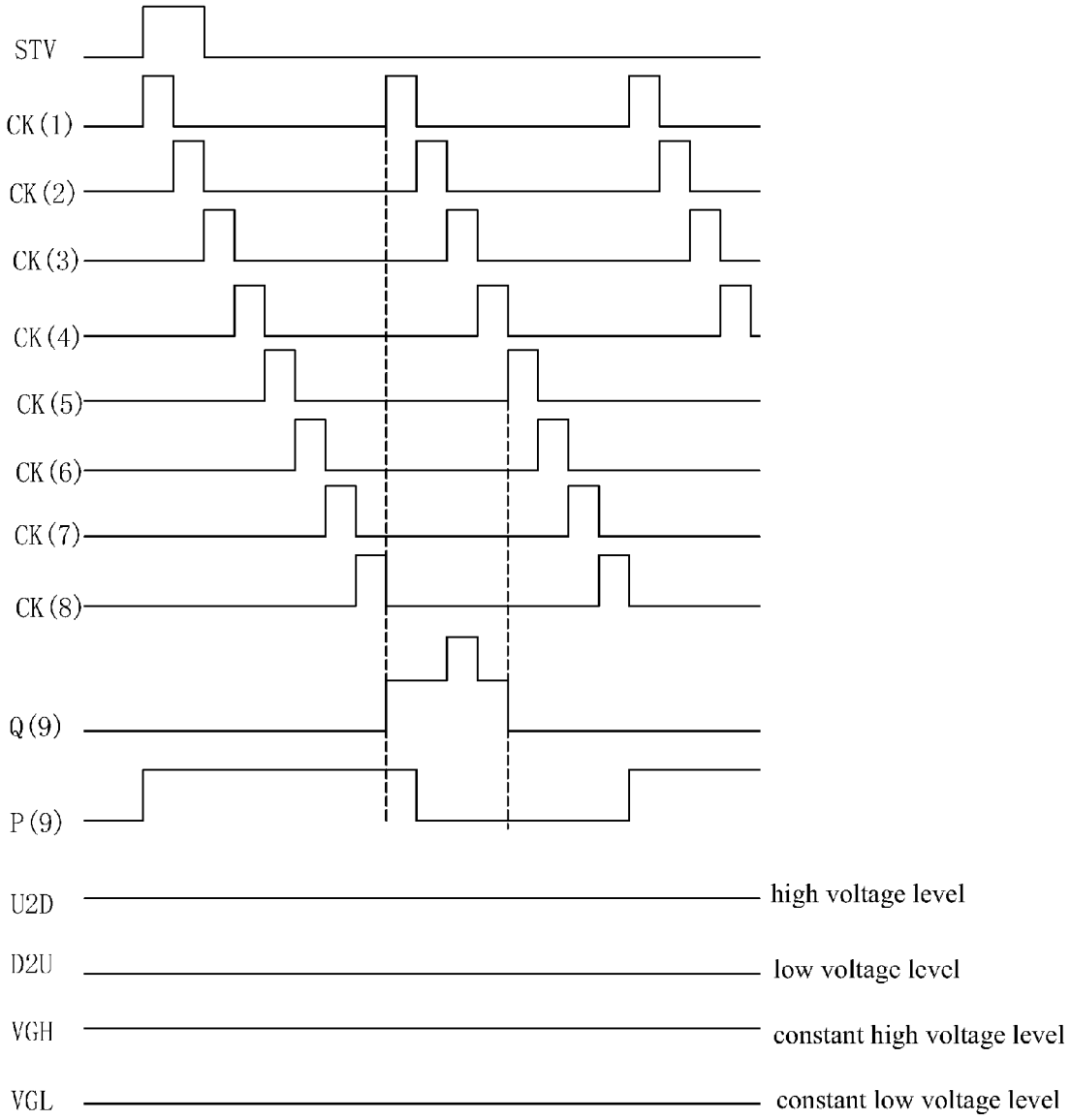
FIG. 2 is a sequence diagram as the GOA circuit shown in FIG. 1 performs forward scan.

Specifically, as shown in FIG. 2, the first, second, third, fourth, fifth, sixth, seventh and eighth clock signals CK(1), CK(2), CK(3), CK(4), CK(5), CK(6), CK(7), CK(8) are the same, and while a pulse signal of the former clock signal is finished, a pulse signal of the latter clock signal is generated. Namely, the first pulse of the first clock signal CK(1) is first generated, and while the first pulse of the first clock signal CK(1) is finished, first pulse of the second clock signal CK(2) is generated, and while the first pulse of the second clock signal CK(2) is finished, the first pulse of the third clock signal CK(3) is generated, and while the first pulse of the third clock signal CK(3) is finished, first pulse of the fourth clock signal CK(4) is generated, and while the first pulse of the fourth clock signal CK(4) is finished, the first pulse of the fifth clock signal CK(5) is generated, and while the first pulse of the fifth clock signal CK(5) is finished, the first pulse of the sixth clock signal CK(6) is generated, and while the first pulse of the sixth clock signal CK(6) is finished, the first pulse of the seventh clock signal CK(7) is generated, and while the first pulse of the seventh clock signal CK(7) is finished, the first pulse of the eighth clock signal CK(8) is generated, and while the first pulse of the eighth clock signal CK(8) is finished, the second pulse of the first clock signal CK(1) is generated. Furthermore, as applying in the first embodiment of the present invention, the falling edge of the former clock signal and the rising edge of the latter clock signal are generated at the same time; as applying in the second embodiment of the present invention, the rising edge of the former clock signal and the falling edge of the latter clock signal are generated at the same time.

Please combine FIG. 1 and FIG. 2. The forward scan of the first embodiment of the present invention is illustrated below for explaining the working procedure of the GOA circuit of the present invention.

In the first embodiment of the present invention, the respective thin film transistors are all N-type thin film transistors, and the first constant voltage level is a constant high voltage level VGH, and the second constant voltage level is a constant low voltage level VGL. As performing forward scan, the forward scan control signal U2D is high voltage level, and the backward scan control signal D2U is low voltage level. Q(9) and P(9) shown in FIG. 2 represent the first node and the second node of the ninth stage GOA unit, and the specific working procedure is below:

First, the output end G(n−2) of the n−2th GOA unit outputs high voltage level (in the first stage and the second stage GOA units, the start signal STV of the circuit is high voltage level), and the ninth thin film transistor T9 is activated, and the sixth thin film transistor T6 is controlled by the constant high voltage level VGH to be constantly activated, and the forward scan control signal U2D of high voltage level charges the first node Q(n) to high voltage level; the first thin film transistor T1, which is controlled by the forward scan control signal U2D of high voltage level is constantly activated, and the M−2th clock signal CK(M−2) provides high voltage level, and the fourth node H(n) is high voltage level, and the third thin film transistor T3 is activated, and the second node P(n) is charged to high voltage level, and the fifth and the eighth thin film transistors T5, T8 are activated, and then, the Mth clock signal CK(M) provides low voltage level, and the fourth thin film transistor T4 is deactivated, and the output end G(n) is pulled down to the constant low voltage level VGL;

then, the M−2th clock signal CK(M−2) and the output end G(n−2) of the n−2th GOA unit become low voltage levels, and the fourth node H(n) is low voltage level, and the third thin film transistor T3 is deactivated, and the first node Q(n) is acted by the first capacitor C1 to maintain high voltage level, and the second thin film transistor T2 controlled by the first node Q(n) is activated to pull down the second node P(n) to low voltage level, and the fifth and the eighth thin film transistors T5, T8 are deactivated;

and then, the Mth clock signal CK(M) becomes high voltage level, and the seventh thin film transistor T7 is controlled by the first node Q(n) to be activated, and the output end G(n) outputs the high voltage level of the Mth clock signal CK(M), and with the function of the first capacitor C1, the first node Q(n) is raised to high voltage level, and the second node P(n) still maintains low voltage level, and the fifth and the eighth thin film transistors T5, T8 are kept to be deactivated;

and, the Mth clock signal CK(M) becomes low voltage level, and the output end G(n) outputs the low voltage level of the Mth clock signal CK(M);

afterward, the output end G(n+2) of the n+2th GOA unit outputs high voltage levels, and the tenth thin film transistor T10 is activated, and the first node Q(n) is pulled down to low voltage level with the backward scan control signal D2U of low voltage level, and the seventh thin film transistor T7 is deactivated, and the second thin film transistor T2 is deactivated, and the second node P(n) maintains to be low voltage level with the function of the second capacitor C2;

finally, the M−2th clock signal CK(M−2) becomes high voltage level, again, and the output end G(n−2) of the n−2th GOA unit maintains to be low voltage levels, and with the function of the first thin film transistor T1, the fourth node H(n) becomes high voltage level, again, and the third thin film transistor T3 is activated, and the second thin film transistor T2 controlled by the first node Q(n) remains to be activated, and the second node P(n) is charged to high voltage level, again, and the fifth and the eighth thin film transistors T5, T8 are activated, and thus, the second node P(n) is kept to be high voltage level with the function of the second capacitor C2, and the output end G(n) maintains to output low voltage level.

The working procedure of the backward scan is similar with the forward scan. What is need is to change the forward scan control signal U2D to be low voltage level, and to change the backward scan control signal D2U to be high voltage level, and the scan direction is changed from scanning from the first stage GOA unit toward the last stage GOA unit to be scanning from the last stage GOA unit toward the first stage GOA unit. No detail description is repeated here.

The second embodiment shown in FIG. 7 is similar with the specific working procedure of the aforesaid first embodiment. Only the high and low of the respective signals and nodes need to be changed. No detail description is repeated here.

In conclusion, the GOA circuit of the present invention comprises a forward-backward scan control module, an output module, an output pull-down module, a node control module, a second node signal input module, a second node signal control module, a voltage stabilizing module and a second capacitor; the forward scan of the circuit is controlled with the ninth and the tenth thin film transistors, and the signal input of the second node is controlled with the first and the eleventh thin film transistors to achieve the low voltage level output of the GOA circuit in the non-working stage, and the mutual control of the first node and the second node are achieved with the second, the fourth and the fifth thin film transistors, and meanwhile, as the GOA circuit applies to a display of dual side drive interlaced scan structure, the GOA circuits of the two sides can respectively receive four different clock signals to reduce the loading of the signal line of the GOA circuit for weakening the delay level of the signal and reducing the power consumption of the GOA circuit, and thus to be adaptable to the working requirements of the display with small size, high resolution.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A GOA circuit, comprising: GOA units of a plurality of stages which are cascade coupled, and the GOA unit of each stage comprises: a forward-backward scan control module, an output module, an output pull-down module, a node control module, a second node signal input module, a second node signal control module, a voltage stabilizing module and a second capacitor;

n is set to be a positive integer, and except the GOA unit of the first stage, the GOA unit of the second stage, the GOA unit of the next to last stage and the GOA unit of the last stage, in the GOA unit of the nth stage:

the forward-backward scan control module comprises: a ninth thin film transistor, and a gate of the ninth thin film transistor is electrically coupled to an output end of the two former stage n−2th GOA unit, and a source receives a forward scan direct current control signal, and a drain is electrically coupled to a third node; and a tenth thin film transistor, and a gate of the tenth thin film transistor is electrically coupled to an output end of the two latter stage n+2th GOA unit, and a source receives a backward scan direct current control signal, and a drain is electrically coupled to a third node;

the output module comprises: a seventh thin film transistor, and a gate of the seventh thin film transistor is electrically coupled to the first node, and a source receives a Mth clock signal, and a drain is electrically coupled to an output end; and a first capacitor, and one end of the first capacitor is electrically coupled to the first node, and the other end is electrically coupled to the output end;

the output pull-down module comprises: an eighth thin film transistor, and a gate of the eighth thin film transistor is electrically coupled to a second node, and a source receive a second constant voltage level, and a drain is electrically coupled to an output end;

the node control module comprises: a fourth thin film transistor, and a gate of the fourth thin film transistor receives the Mth clock signal, and a source is electrically coupled to the third node, and a drain is electrically coupled to a drain of a fifth thin film transistor; the fifth thin film transistor, and a gate of the fifth thin film transistor is electrically coupled to the second node, and a source receives the second constant voltage level; and a second thin film transistor, and a gate of the second thin film transistor is electrically coupled to the third node, and a source is electrically coupled to the second node, and a drain is electrically coupled to a fourth node;

the second node signal input module comprises: a third thin film transistor, and a gate of the third thin film transistor is electrically coupled to the fourth node, and a source is electrically coupled to a first constant voltage level, and a drain is electrically coupled to the second node;

the second node signal control module comprises: a first thin film transistor, and a gate of the first thin film transistor receives the forward scan direct current control signal, and a source receives a M−2th clock signal, and a drain is electrically coupled to the fourth node; and an eleventh thin film transistor, and a gate of the eleventh thin film transistor receives the backward scan direct current control signal, and a source receives a M+2th clock signal, and a drain is electrically coupled to the fourth node;

the voltage stabilizing module comprises: a sixth thin film transistor, and a gate of the sixth thin film transistor receives the first constant voltage level, and a source is electrically coupled to the third node, and a drain is electrically coupled to the first node;

one end of the second capacitor is electrically coupled to the second node, and the other end is electrically coupled to the second constant voltage level;

the voltages of the forward scan direct current control signal and the backward scan direct current control signal are one high and one low, and the voltages of the first constant voltage level and the second constant voltage level are one high and one low.

2. The GOA circuit according to claim 1, wherein in the first stage GOA unit and the second stage GOA unit, the gate of the ninth thin film transistor receives a start signal of the circuit.

3. The GOA circuit according to claim 1, wherein in the next to last stage GOA unit and the last stage GOA unit, the gate of the tenth thin film transistor receives a start signal of the circuit.

4. The GOA circuit according to claim 1, wherein the respective thin film transistors are all N-type thin film transistors, and the first constant voltage level is a constant high voltage level, and the second constant voltage level is a constant low voltage level.

5. The GOA circuit according to claim 4, wherein as performing forward scan, the forward scan direct current control signal is high voltage level and the backward scan direct current control signal is low voltage level; and as performing backward scan, the forward scan direct current control signal is low voltage level and the backward scan direct current control signal is high voltage level.

6. The GOA circuit according to claim 1, wherein the respective thin film transistors are all P-type thin film transistors, and the first constant voltage level is a constant low voltage level, and the second constant voltage level is a constant high voltage level.

7. The GOA circuit according to claim 6, wherein as performing forward scan, the forward scan direct current control signal is low voltage level and the backward scan direct current control signal is high voltage level; and as performing backward scan, the forward scan direct current control signal is high voltage level and the backward scan direct current control signal is low voltage level.

8. The GOA circuit according to claim 1, wherein as applying to a display of dual side drive interlaced scan structure, two GOA circuit are respectively at left, right two sides of display active display area, the GOA circuit of one side only comprises the odd stage GOA units, and the GOA circuit of the other side only comprises even stage GOA units;

wherein the respective GOA units in the GOA circuit at the one side receive four clock signals: a first clock signal, a third clock signal, a fifth clock signal and a seventh clock signal; the respective GOA units in the GOA circuit at the other side receive four clock signals: a second clock signal, a fourth clock signal, a sixth clock signal and an eighth clock signal.

9. The GOA circuit according to claim 8, wherein the pulse periods of the first, second, third, fourth, fifth, sixth, seventh and eighth clock signals are the same, and while a pulse signal of the former clock signal is finished, a pulse signal of the latter clock signal is generated.

10. The GOA circuit according to claim 8, wherein as the Mth clock signal is the first clock signal, the M−2th clock signal is the seventh clock signal; as the Mth clock signal is the second clock signal, the M−2th clock signal is the eighth clock signal; as the Mth clock signal is the seventh clock signal, the M+2th clock signal is the first clock signal; as the Mth clock signal is the eighth clock signal, the M+2th clock signal is the second clock signal.

11. A GOA circuit, comprising: GOA units of a plurality of stages which are cascade coupled, and the GOA unit of each stage comprises: a forward-backward scan control module, an output module, an output pull-down module, a node control module, a second node signal input module, a second node signal control module, a voltage stabilizing module and a second capacitor;

n is set to be a positive integer, and except the GOA unit of the first stage, the GOA unit of the second stage, the GOA unit of the next to last stage and the GOA unit of the last stage, in the GOA unit of the nth stage:

the forward-backward scan control module comprises: a ninth thin film transistor, and a gate of the ninth thin film transistor is electrically coupled to an output end of the two former stage n−2th GOA unit, and a source receives a forward scan direct current control signal, and a drain is electrically coupled to a third node; and a tenth thin film transistor, and a gate of the tenth thin film transistor is electrically coupled to an output end of the two latter stage n+2th GOA unit, and a source receives a backward scan direct current control signal, and a drain is electrically coupled to a third node;

the output module comprises: a seventh thin film transistor, and a gate of the seventh thin film transistor is electrically coupled to the first node, and a source receives a Mth clock signal, and a drain is electrically coupled to an output end; and a first capacitor, and one end of the first capacitor is electrically coupled to the first node, and the other end is electrically coupled to the output end;

the output pull-down module comprises: an eighth thin film transistor, and a gate of the eighth thin film transistor is electrically coupled to a second node, and a source receive a second constant voltage level, and a drain is electrically coupled to an output end;

the node control module comprises: a fourth thin film transistor, and a gate of the fourth thin film transistor receives the Mth clock signal, and a source is electrically coupled to the third node, and a drain is electrically coupled to a drain of a fifth thin film transistor; the fifth thin film transistor, and a gate of the fifth thin film transistor is electrically coupled to the second node, and a source receives the second constant voltage level; and a second thin film transistor, and a gate of the second thin film transistor is electrically coupled to the third node, and a source is electrically coupled to the second node, and a drain is electrically coupled to a fourth node;

the second node signal input module comprises: a third thin film transistor, and a gate of the third thin film transistor is electrically coupled to the fourth node, and a source is electrically coupled to a first constant voltage level, and a drain is electrically coupled to the second node;

the second node signal control module comprises: a first thin film transistor, and a gate of the first thin film transistor receives the forward scan direct current control signal, and a source receives a M−2th clock signal, and a drain is electrically coupled to the fourth node; and an eleventh thin film transistor, and a gate of the eleventh thin film transistor receives the backward scan direct current control signal, and a source receives a M+2th clock signal, and a drain is electrically coupled to the fourth node;

the voltage stabilizing module comprises: a sixth thin film transistor, and a gate of the sixth thin film transistor receives the first constant voltage level, and a source is electrically coupled to the third node, and a drain is electrically coupled to the first node;

one end of the second capacitor is electrically coupled to the second node, and the other end is electrically coupled to the second constant voltage level;

the voltages of the forward scan direct current control signal and the backward scan direct current control signal are one high and one low, and the voltages of the first constant voltage level and the second constant voltage level are one high and one low;

wherein in the first stage GOA unit and the second stage GOA unit, the gate of the ninth thin film transistor receives a start signal of the circuit;

wherein in the next to last stage GOA unit and the last stage GOA unit, the gate of the tenth thin film transistor receives a start signal of the circuit;

wherein as applying to a display of dual side drive interlaced scan structure, two GOA circuit are respectively at left, right two sides of display active display area, the GOA circuit of one side only comprises the odd stage GOA units, and the GOA circuit of the other side only comprises even stage GOA units;

wherein the respective GOA units in the GOA circuit at the one side receive four clock signals: a first clock signal, a third clock signal, a fifth clock signal and a seventh clock signal; the respective GOA units in the GOA circuit at the other side receive four clock signals: a second clock signal, a fourth clock signal, a sixth clock signal and an eighth clock signal.

12. The GOA circuit according to claim 11, wherein the respective thin film transistors are all N-type thin film transistors, and the first constant voltage level is a constant high voltage level, and the second constant voltage level is a constant low voltage level.

13. The GOA circuit according to claim 12, wherein as performing forward scan, the forward scan direct current control signal is high voltage level and the backward scan direct current control signal is low voltage level; and as performing backward scan, the forward scan direct current control signal is low voltage level and the backward scan direct current control signal is high voltage level.

14. The GOA circuit according to claim 11, wherein the respective thin film transistors are all P-type thin film transistors, and the first constant voltage level is a constant low voltage level, and the second constant voltage level is a constant high voltage level.

15. The GOA circuit according to claim 14, wherein as performing forward scan, the forward scan direct current control signal is low voltage level and the backward scan direct current control signal is high voltage level; and as performing backward scan, the forward scan direct current control signal is high voltage level and the backward scan direct current control signal is low voltage level.

16. The GOA circuit according to claim 11, wherein the pulse periods of the first, second, third, fourth, fifth, sixth, seventh and eighth clock signals are the same, and while a pulse signal of the former clock signal is finished, a pulse signal of the latter clock signal is generated.

17. The GOA circuit according to claim 11, wherein as the Mth clock signal is the first clock signal, the M−2th clock signal is the seventh clock signal; as the Mth clock signal is the second clock signal, the M−2th clock signal is the eighth clock signal; as the Mth clock signal is the seventh clock signal, the M+2th clock signal is the first clock signal; as the Mth clock signal is the eighth clock signal, the M+2th clock signal is the second clock signal.

* * * * *